US006843001B2

(12) United States Patent
Jenne

(10) Patent No.: US 6,843,001 B2
(45) Date of Patent: Jan. 18, 2005

(54) SCRAPER

(76) Inventor: Richard Jenne, R.R. #2, Drumbo, Ontario (CA), N0J 1G0

( * ) Notice: Subject to any disclaimer, the term of this patent is extended or adjusted under 35 U.S.C. 154(b) by 0 days.

(21) Appl. No.: 10/448,309

(22) Filed: May 30, 2003

(65) Prior Publication Data

US 2004/0237352 A1 Dec. 2, 2004

(51) Int. Cl.[7] ..... E02F 5/08
(52) U.S. Cl. ..... 37/93
(58) Field of Search ..... 37/347, 366, 189, 37/269, 91–93; 299/39; 404/90

(56) References Cited

U.S. PATENT DOCUMENTS

| | | | | |
|---|---|---|---|---|
| 1,416,991 A | * | 5/1922 | Starling | 37/366 |
| 1,517,016 A | | 11/1924 | Relien | |
| 1,637,673 A | * | 8/1927 | Atkins, Jr. et al. | 172/387 |
| 3,846,923 A | * | 11/1974 | Whittier | 37/366 |
| 4,148,365 A | | 4/1979 | Anderson | |
| 4,658,519 A | | 4/1987 | Quenzi | |
| 4,802,293 A | | 2/1989 | Smith | |
| 4,887,372 A | * | 12/1989 | Block | 37/91 |
| 5,511,326 A | * | 4/1996 | Liebrecht, Jr. | 37/93 |
| 5,529,131 A | | 6/1996 | Van Ornum | |
| 5,890,546 A | | 4/1999 | Kerpash, Sr. | |
| 5,960,569 A | | 10/1999 | Molstad | |
| 6,308,785 B1 | | 10/2001 | Rhoden | |
| RE37,628 E | | 4/2002 | Segorski et al. | |

FOREIGN PATENT DOCUMENTS

| | | |
|---|---|---|
| JP | 63223230 | 9/1988 |
| JP | 2311607 | 12/1990 |

* cited by examiner

*Primary Examiner*—Robert E Pezzuto

(57) ABSTRACT

A scraper for moving friable material. The scraper includes a frame adapted for attachment to a vehicle and an articulated blade. The blade has left and right portions mounted on the frame for pivoting about a substantially horizontal axis transverse to the articulated blade. Each of the left and right portions of the articulated blade is adapted for pivotal movement about the axis between a substantially horizontal lowered position and a raised position, and each portion is independently positionable in at least one position between the lowered position and the raised position. The articulated blade is positionable for engagement with the friable material as the vehicle travels over the friable material for moving a part of the friable material to shape the friable material in accordance with a predetermined design.

9 Claims, 12 Drawing Sheets

SCRAPER

FIELD OF THE INVENTION

This invention relates to scrapers for moving friable material and, in particular, scrapers with articulated blades having independently movable left and right portions.

BACKGROUND OF THE INVENTION

Devices for shaping and configuring friable material such as soil are known. For example, U.S. Pat. No. 5,980,569 (Molstad) discloses an articulated dozer blade system for performing dozing operations using an articulated blade. However, the articulated dozer blade disclosed in Molstad can only pivot about an axis which is vertical, or substantially vertical, thereby limiting the applications in which this dozer blade system can be used.

Other known devices, such as an adjustable grader-spreader bar disclosed in U.S. Pat. No. 6,308,785 (Rhoden) and a snowplow disclosed in U.S. Pat. No. 1,617,016 (Relien), include features which permit adjustment of a blade in a restricted manner. For instance, the grader-spreader bar disclosed in Rhoden has a blade frame assembly including a plurality of blade frames. The blade frames are slideably connected So that they have an adjustable overlap. Actuating devices are used to extend or retract the blade frames, resulting in adjustments to the width of the grader-spreader bar. Ground-engaging skids are attached to each side of the blade frame assembly, and the vertical position of each ground-engaging skid is adjustable. It appears that the vertical positions of the ground-engaging skids are adjustable to only a limited extent, however, so that the blade frame assembly can be positioned within a somewhat limited range of angles to the horizontal.

As another example of the prior art, the snowplow disclosed in Relien includes two blades (10, 11) and a backbone (12) having a pair of plates (14, 15). A second plate (i.e., plate 15) is positioned higher than a first plate (i.e., plate 14), and the second plate is pivotally attached to the first plate, so that the second plate can be tilted relative to the first plate. Also, the blade (11) attached to the second plate tilts with the second plate because the blade (11) is rigidly attached to the second plate. However, it appears that the snowplow disclosed in Relien permits only one of two blades to be tilted, i.e., raised at one end thereof in a vertical plane.

Because of the limits on adjustability of blades in the known devices, the known devices are not suitable for use in certain applications. For example, it is often desirable to form a relatively shallow depression, or swale, in landscaping at or around residential or commercial premises. A swale is often needed for controlling drainage, especially at or near property boundaries or between adjacent buildings. FIG. 1 shows a typical swale 20 located between buildings 22, 24. Although a variety of swale designs are used, the swale 20 is shown in FIG. 1 with a furrow or channel 26 positioned approximately centrally in the swale 20, substantially aligned with a property boundary 27. (For convenience, only portions of the foundation walls of the buildings 22, 24 are shown in FIG. 1). The swale 20 is constructed in a specified location 28 according to a predetermined swale design which is intended to result in the flow of surface groundwater over the swale 20 towards a street 29 consistent with design parameters which are in accordance with municipal or other applicable regulations. The direction of flow of surface groundwater in the typical swale 20 is away from the buildings 22, 24 and toward the street 29, as indicated by arrows A, B, and C in FIG. 1.

A cross-section of a typical swale is shown in FIG. 1A. In FIG. 1A, it is assumed that the swale as built is in accordance with the design. As can be seen in FIG. 1A, the swale surfaces 30, 32 are separated by the furrow or channel 26, which typically is substantially horizontal. Often the buildings 22, 24 are separated by a relatively small distance D. Typically, the distance separating the buildings 22, 24 is as little as approximately 6 feet, or less. As shown in FIG. 1, the swale 20 typically is located on a first property line 33. In most cases, additional swales 34, 35 are located between the houses 22, 24 and a rear property boundary 36 in order to cause surface groundwater to run off into the swale 20, as indicated by arrows F.

Because of the relatively restricted area in which the swale 20 is formed, in the prior art, the swale 20 is usually formed using manual labor, i.e., with shovels and rakes. The surfaces 30. 32 are usually positioned at approximately 1°–35° from the horizontal, as can be seen in FIG. 1A. Also, in a typical swale, the furrow or channel 26 extends from an upstream end 38 to a downstream end 40, and the grade from the downstream end 40 to the upstream end 38 generally varies between approximately 2% to approximately 16%. Known devices are not suitable for making swales in a relatively limited area and to the specifications required, due to the limitations of known devices, as described above.

There is therefore a need for a scraper with an articulated blade having independently movable left and right portions.

SUMMARY OF THE INVENTION in a broad aspect of the present invention, there is provided a scraper for moving friable material. The scraper includes a frame adapted for attachment to a vehicle and an articulated blade. The articulated blade has left and right portions mounted on the frame for pivoting about a substantially horizontal axis transverse to the articulated blade. Each of the left and right portions of the articulated blade is adapted for pivotal movement about the axis between a substantially horizontal lowered position and a raised position. Each portion is independently positionable in at least one position between the lowered position and the raised position. The articulated blade is positionable for engagement with the friable material as the vehicle travels over the friable material, for moving a part of the friable material to shape the friable material in accordance a predetermined design.

In another aspect, the invention provides a scraper for moving friable material, in which the scraper includes a frame adapted for attachment to a vehicle, an articulated blade, and a shield. The articulated blade has left and right portions mounted on the frame for pivoting independently of each other. Each of the left and right portions of the articulated blade is adapted for pivotal movement between a lowered position and a raised position, such that movement of at least one of the left and right portions from the lowered position opens a gap between the left and right portions. The shield is adapted for moving friable material and attached to the frame and positioned for alignment with the gap so that the friable material is moveable by the articulated blade and the shield to conform with a predetermined design.

BRIEF DESCRIPTION OF THE DRAWINGS

The invention will be better understood with reference to the drawings, in which.

DETAILED DESCRIPTION OF THE PREFERRED EMBODIMENT(S)

Figure 1:
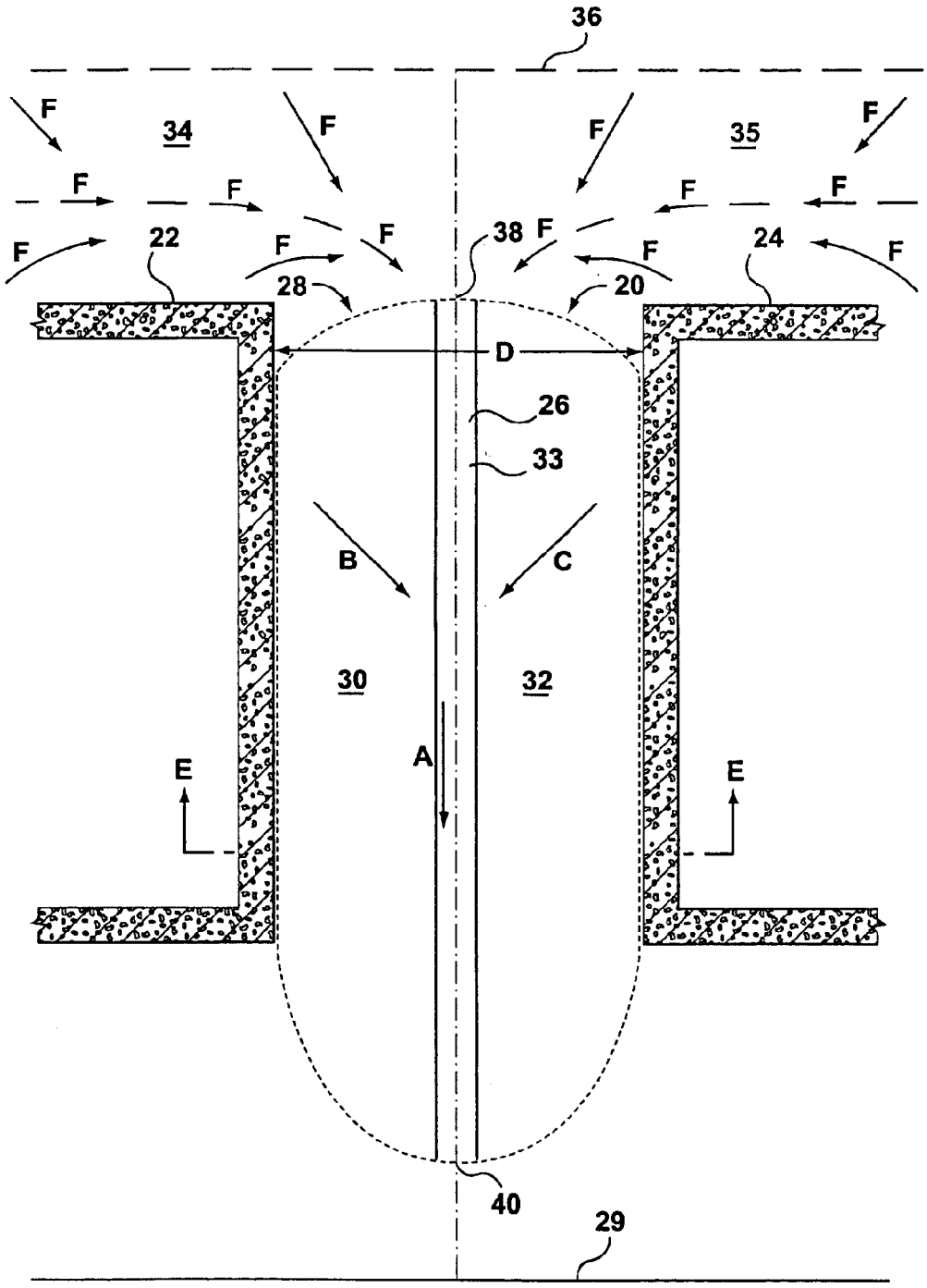
FIG. 1 (also described previously) is a plan view of a typical swale design located between two buildings.
Figure 1A:
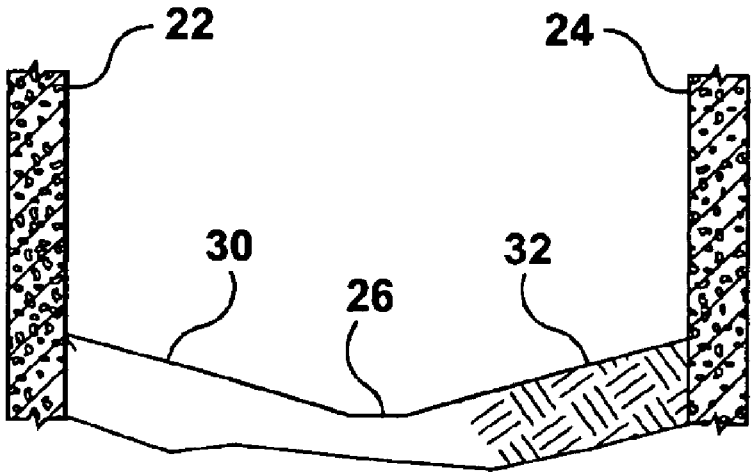
FIG. 1A (also described previously) is a cross-section of the typical swale design of FIG. 1, taken along line E—E.
Figure 2:
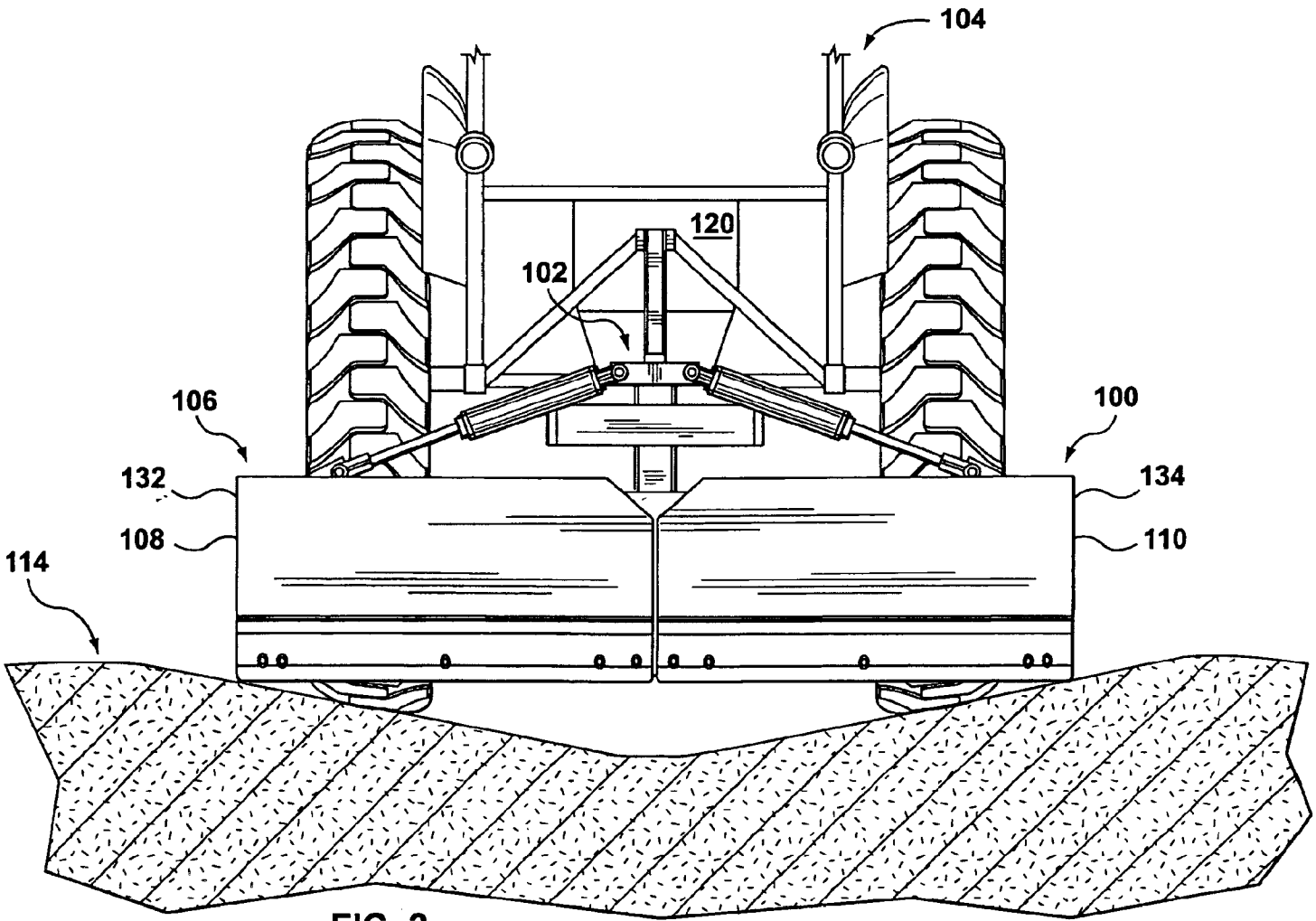
FIG. 2 is a back view of a preferred embodiment of the scraper mounted on a vehicle showing a left portion and a right portion of an articulated blade in a lowered position, drawn at a larger scale.
Figure 3:
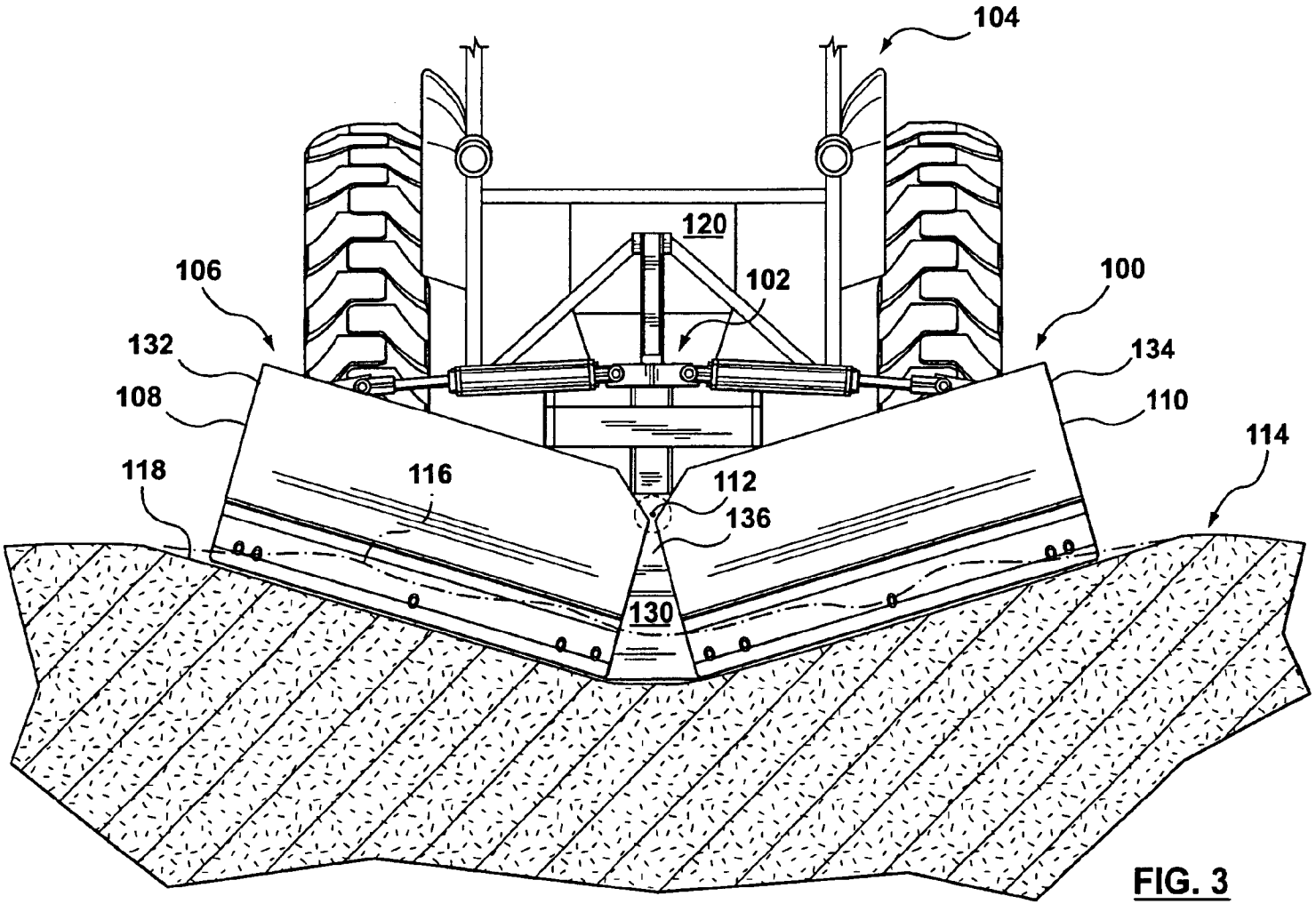
FIG. 3 is a back view of the scraper of FIG. 2 showing the left portion and the right portion of the articulated blade in an intermediate position.
Figure 4:
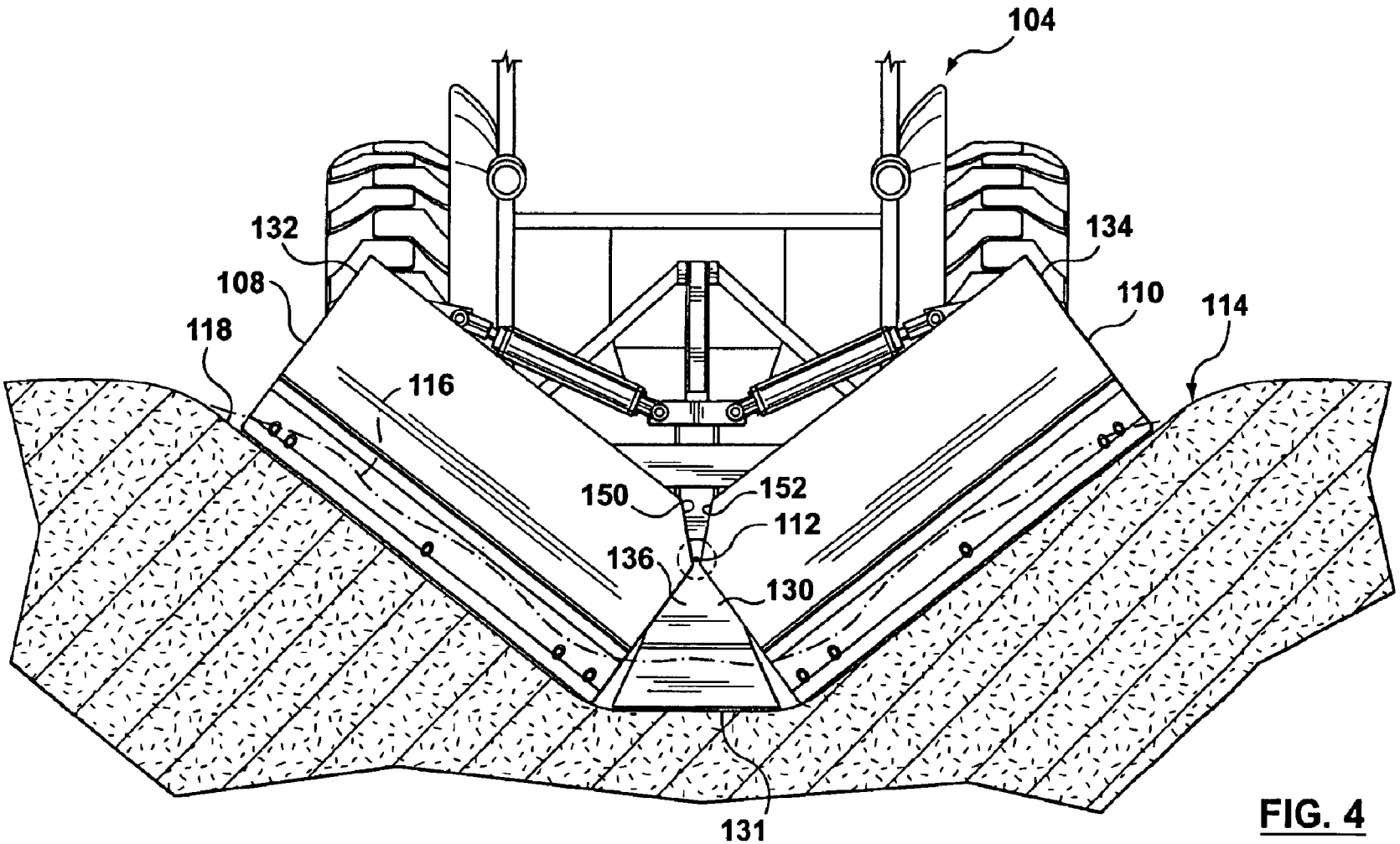
FIG. 4 is a back view of the scraper of FIG. 2 showing the left portion and the right portion of the articulated blade in a fully raised position.

Reference is first made to FIGS. 2–4 to describe a preferred embodiment of a scraper indicated generally by the numeral 100 in accordance with the invention. The scraper 100 includes a frame 102 adapted for attachment to a vehicle 104 and an articulated blade 106 having left and right portions 108, 110 mounted on the frame 102. As can be seen in FIGS. 2–4, the left and fight portions 108, 110 are mounted on the frame 102 for pivoting about a substantially horizontal axis 112 (FIG. 6) positioned transverse to the articulated blade 106. In the preferred embodiment, each of the left and right portions 108, 110 is adapted for pivotal movement about the axis 112 between a substantially horizontal lowered position (FIG. 2) and a raised position (FIG. 4). In addition, each portion 108, 110 is independently positionable in at least one position intermediate between the lowered position and the raised position (FIG. 3). As shown in FIGS. 3 and 4, the articulated blade 100 is positionable for engagement with friable material 114 as the vehicle 104 travels over the friable material for moving a part 116 of the friable material as the vehicle 104 travels over the friable material to shape the friable material in accordance with a predetermined design 118.

As can be seen in FIGS. 2–4, the scraper 100 is preferably attached to a back end 120 of the vehicle 104. In the description which follows, the terms left, right, front, and rear are all with respect to the direction of travel of the scraper as it is being towed by the vehicle 104 as the vehicle 104 s traveling forward.

Preferably, the vehicle 104 is a tractor including a 3-point hitch assembly at the back end 120 to which the frame 102 is attached. The 3-point hitch assembly supports the frame 102, and is supported by hydraulic cylinders (not shown) operably connected to the tractors hydraulic system, as is known in the art. The frame 102 can be maintained at a height selected by an operator (not shown) by the threepoint hitch assembly, and the height can be adjusted by the operator, by means of the hydraulic cylinders supporting the three-point hitch assembly. Also, the three-point hitch assembly can be used to lift the frame 102 so that the scraper 100 is not engaged with the friable material, for easy transportation. In the preferred embodiment, the hydraulic system of the tractor 104 also provides the means for raising or lowering the left and right portions 108, 110, as will be described. Preferably, the means for raising or lowering the left and right portions 108, 110 of the articulated blade 106 are controllable so that the engagement of the articulated blade 106 with the friable material 114 is variable in accordance with the predetermined design 118 as the tractor 104 is moving.

Figure 5:
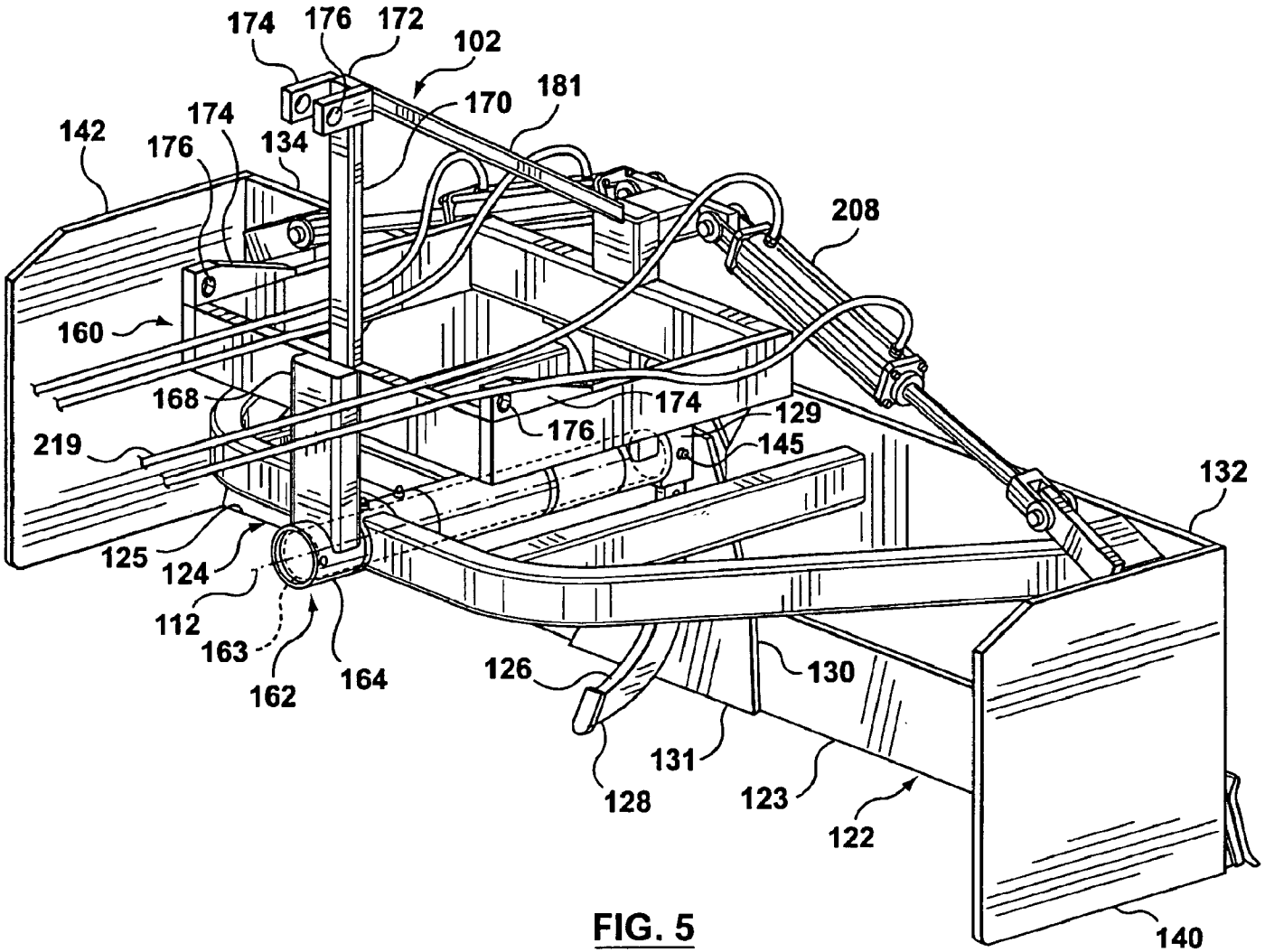
FIG. 5 is an isometric view of the scraper of FIG. 2 from the front and the left side thereof, drawn at a larger scale.
Figure 6:
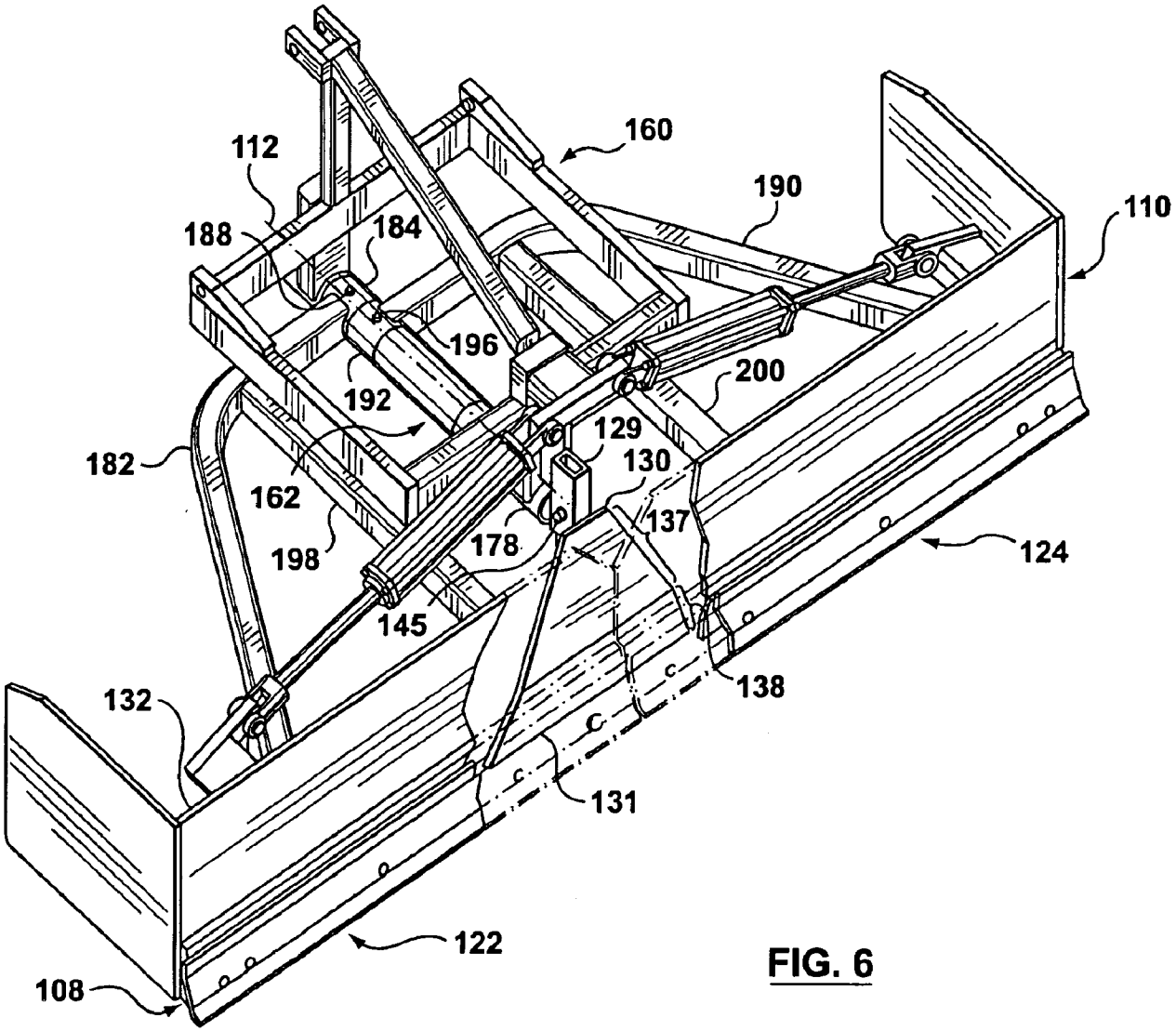
FIG. 6 is an isometric view of the scraper of FIG. 2 from the back and the left side thereof, with part of the articulated blade cut away to show a shield.
Figure 7:
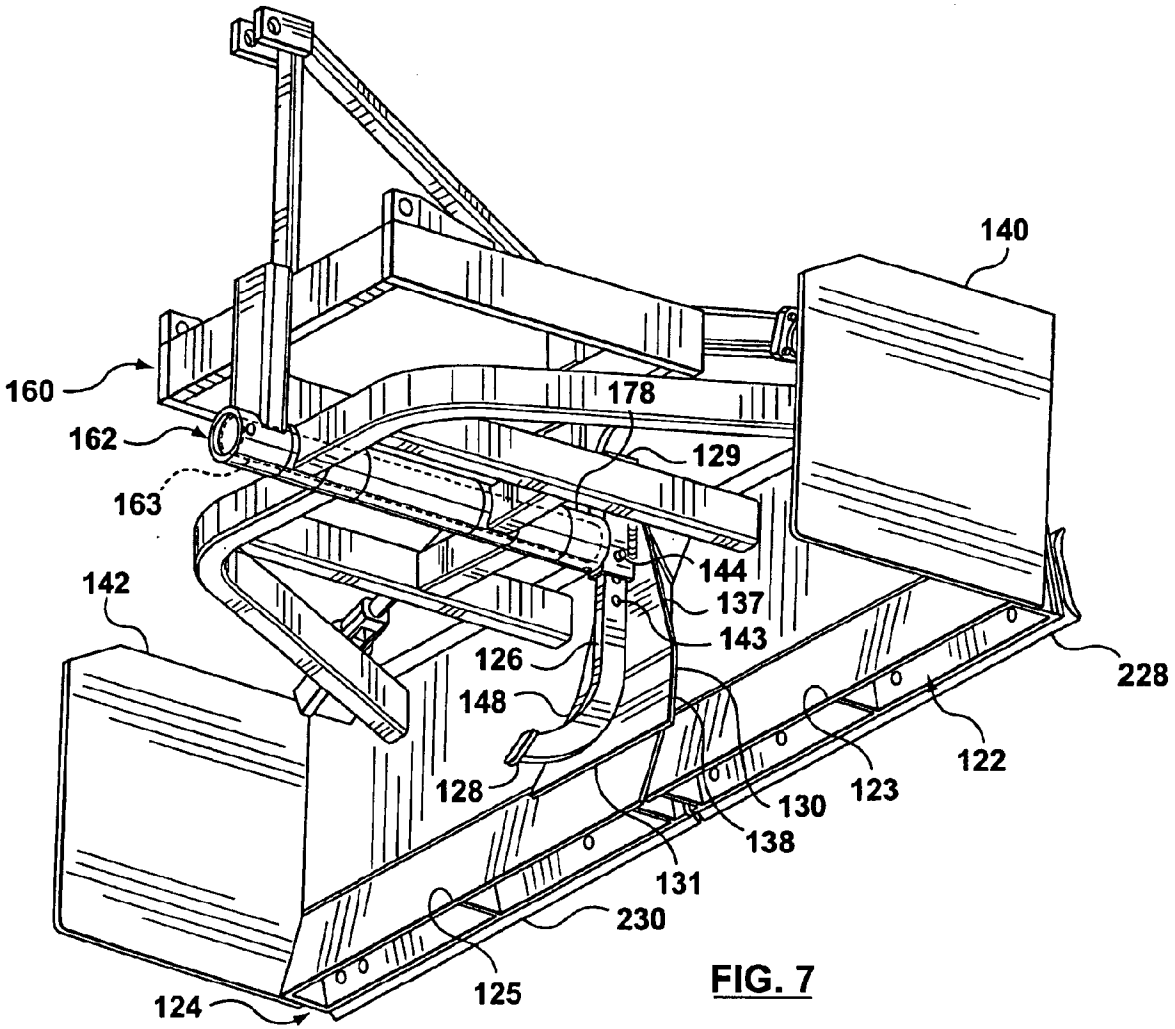
FIG. 7 is an isometric view of the scraper of FIG. 2 from the bottom and the front thereof.

Preferably, and as shown in FIGS. 5–7, each of the left and right portions 108, 110 has a bottom edge assembly 122, 124 respectively adapted for engaging the friable material 114, as will be described in more detail. The left bottom edge assembly 122 includes a forward cutting edge 123, and the right bottom edge assembly 124 includes a forward cutting edge 125. As can be seen in FIG. 7, the scraper 100 preferably also includes a hook 126 extending downwardly from a proximal end (not shown) to a distal end 128 thereof.

As shown in FIGS. 6 and 7, the hook 126 is retained in a sleeve 129 so that the distance separating the frame 102 and the distal end 128 is variable. As will be described, the sleeve 129 forms part of the frame 102. If it is desired to use the hook 126 to break up relatively hard friable material, the hook 126 can be lowered to a first position (FIG. 9), in which the distal end 128 extends well below the bottom edge assemblies 122, 124, as will be described. However, for most operations, the distal end 128 is preferably positioned in a second position (FIGS. 7 and 11), located approximately as far below the frame 102 as the forward cutting edges 123, 125, when the left and right portions 108, 110 are in the lowered position.

Figure 9:
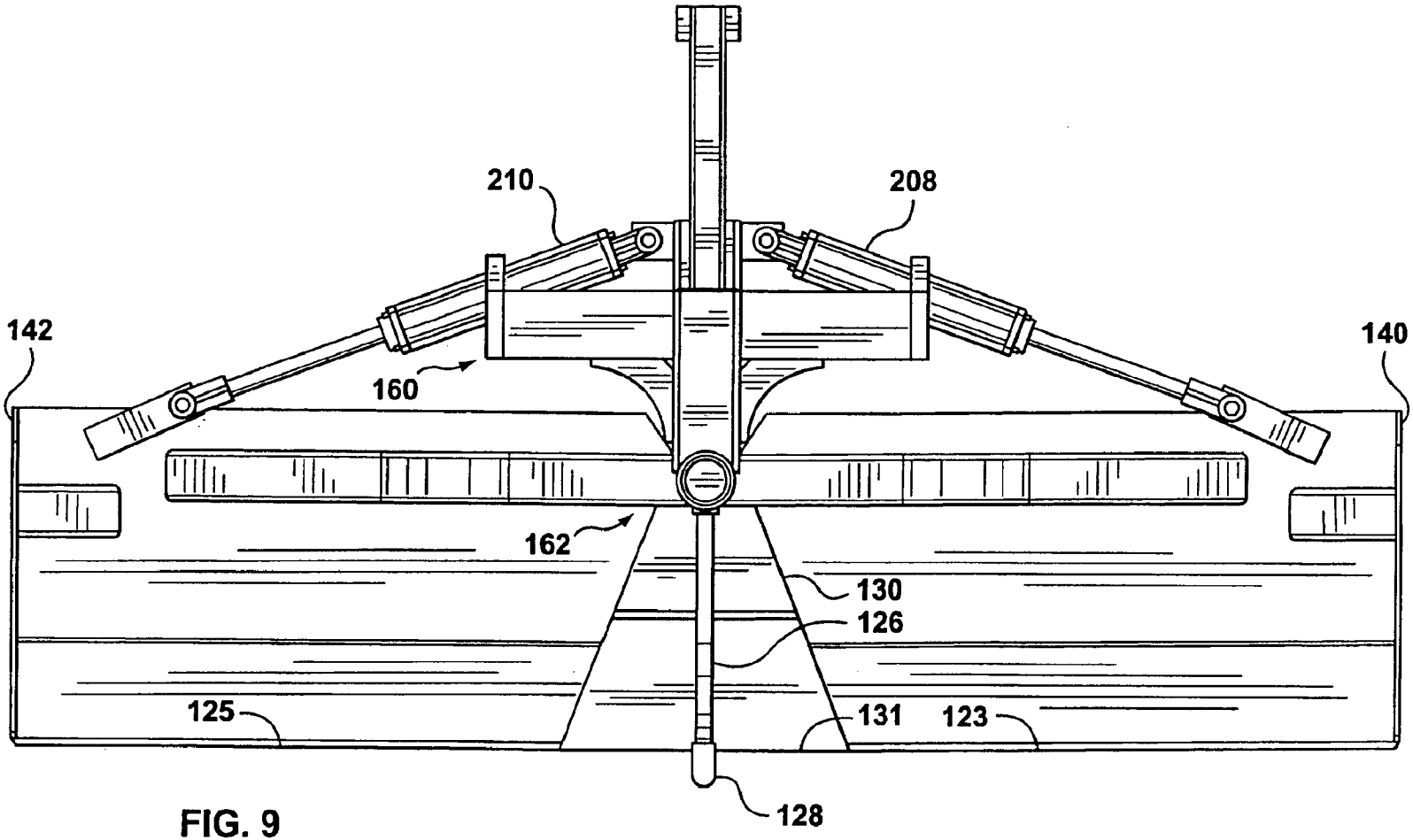
FIG. 9 is a front view of the scraper of FIG. 2.
Figure 11:
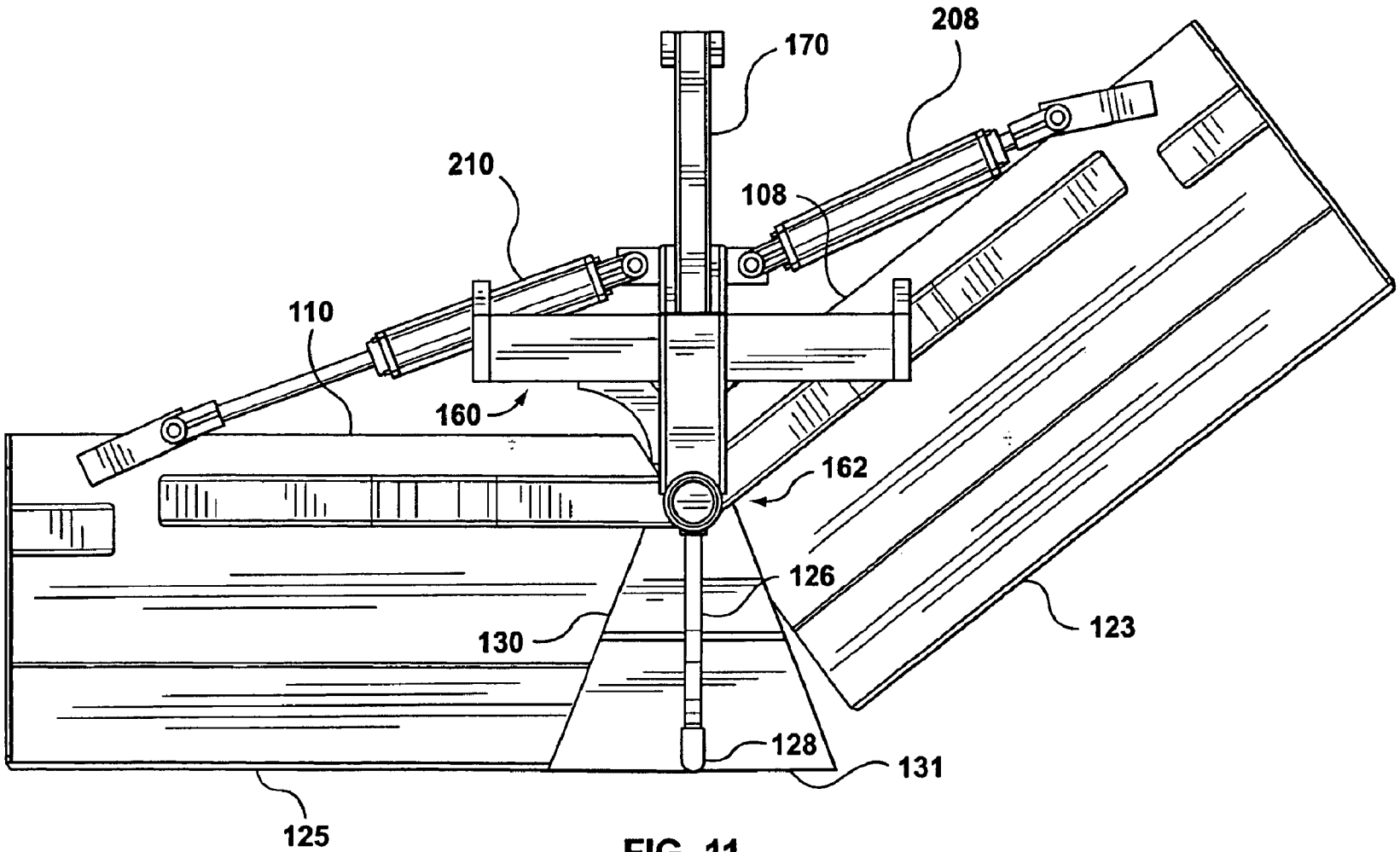
FIG. 11 is a front view of the scraper of FIG. 2 showing the left portion of the articulated blade in the fully raised position.

FIGS. 3–4 and 5–7 also snow a shield 130 included in the scraper 100. The shield 130 is preferably attached to the sleeve 129 and extends downwardly to end at a shield edge 131. For example, as can be seen in FIG. 7, the shield 130 can be welded to the sleeve 129. As can be seen in FIGS. 9 and 11, in the preferred embodiment, the shield edge 131 is substantially at the same height as the forward cutting edges 123. 125 when the left and right portions 108. 110 are in the lowered position. The shield 130 is adapted for plowing, or moving, the friable material 114 as the vehicle 104 travels over the friable material 114 in accordance with the predetermined design 118, as shown in FIG. 6.

Figure 8:
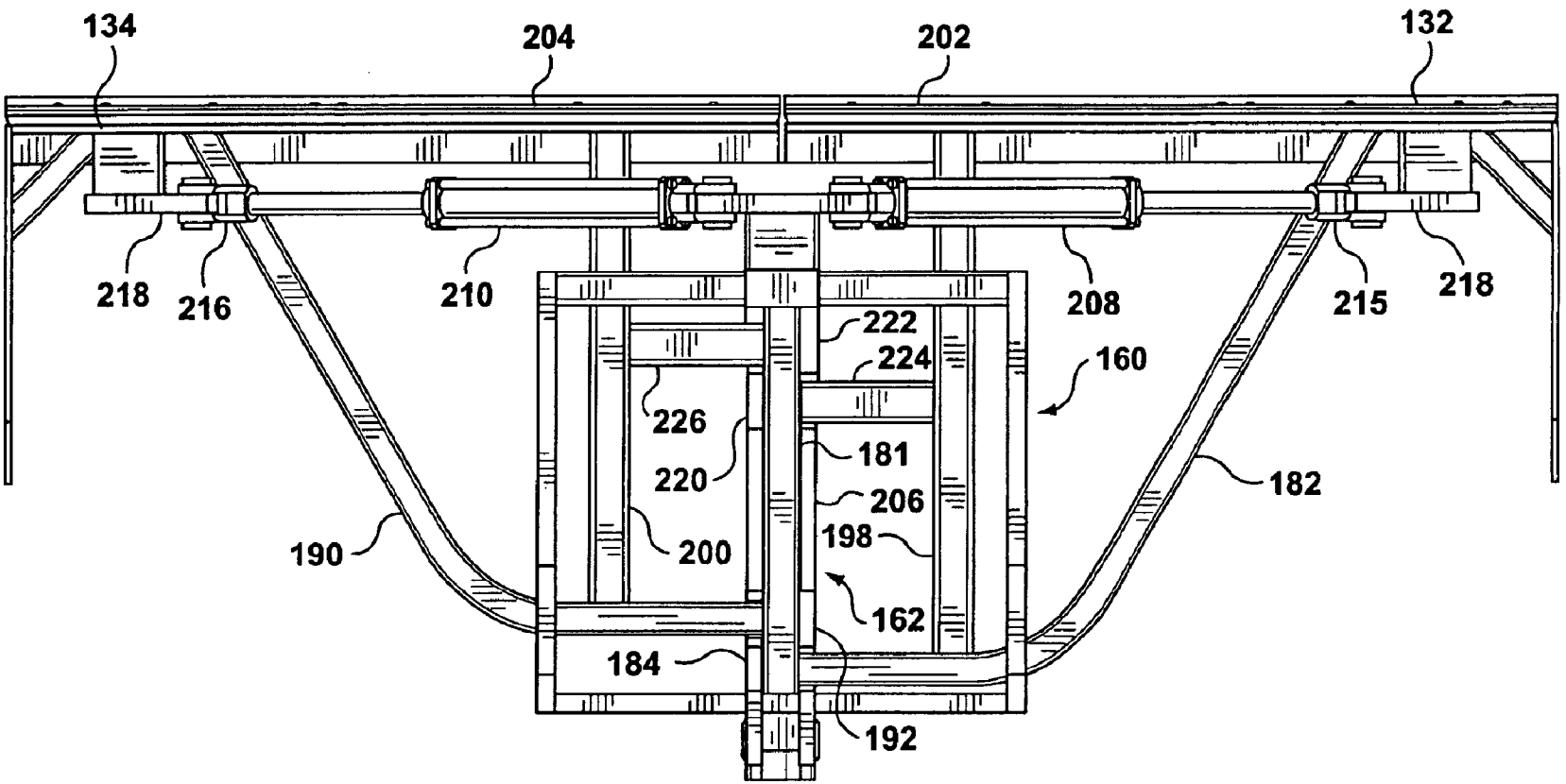
FIG. 8 is a top view of the scraper of FIG. 2.

As shown in FIGS. 2–4, distal ends 132, 134 of the left and right portions 108, 110 respectively are pivotable upwardly when the left and right portions 108, 110 (or either of them) are moved up from the lowered position, rotating about the horizontal axis 112. When this happens, a gap 130 opens between the left and right portions 108, 110. As shown in FIGS. 3 and 4, the shield 130 is configured and positioned to be aligned with the gap 136. It can also be seen in FIGS. 3, 4, and 8 that the shield 130 preferably overlaps with the let and right portions 108, 110. Regardless of whether the vehicle 104 is moving forwards or backwards, the shield 130 covers the gap 136 so that the scraper 100 effectively moves friable material 114 while the left and right portions 108, 110 are positioned in accordance with the design 118. As shown in FIG. 8, the shield 130 preferably includes an upper part 137 which is attached to the sleeve 129 and a lower part 138 including the edge 131, which lower part 138 is angled slightly forward, to project the shield edge 131 slightly forwardly.

In the preferred embodiment, and as can be seen in FIGS. 5–8, the frame 102 is positioned forward of the left and right portions 108. 110. It is also preferred that the scraper 100 additionally includes left and right side walls 140, 142 attached to the distal ends 132, 134 of the left and right portions 108, 110 respectively. The left and right side walls 140, 142 are positioned substantially orthogonally to the left and right portions 108, 110 and extend forwardly therefrom. The left and right side walls 140, 142 are adapted to cooperate with the articulated blade 106 to retain friable material 114 as the vehicle 104 travels forward when the articulated blade 106 is engaged with the friable material 114.

The hook 126 preferably includes a plurality of holes 143, for alignment with a hole 144 in the sleeve 129. The hook 126 is held in position relative to the sleeve 129 when one of the holes 143 is aligned with the hole 144 and a pin 145 is inserted through the holes 143, 144. It can be seen that adjustment of the height of the distal and 128 can easily be accomplished by removal of the pin 145 to permit adjustment The pin 145 is reinserted in the holes 143, 144 once the hook 126 is in the desired position.

Preferably, the hook 126 includes a curved portion 148 which is curved forwardly to the distal end 128, and adapted to break up relatively hard friable material 114 by plowing a furrow, or making a channel, therein. The hook 126 is preferably used in this way when in the first position (FIG. 9) to plow a furrow in friable material 114 which has developed a relatively hard crust, or has agglomerated, as the vehicle 104 is moving forward.

As can be seen in FIGS. 2–4, the left and right portions 108, 110 both have notches 150. 152 cut in them in order to facilitate upward pivotal movement of distal ends 132, 134 of the left and fight portions 108, 110.

The frame 102 includes an upper member 160 and a lower member 162, as can be seen in FIGS. 5–11. The lower member 162 comprises a tube 163 coaxial with a series of housing portions, and coaxial with the axis 112. As can be seen in FIG. 5, a first housing portion 164 is positioned at a forward end of the lower member 162. The first housing portion 164 is rigidly attached to the tube 163 by means of a fastener 166, and a first upright member 168 is attached to the first housing portion 164, the first upright member 168 extending upwardly to support the upper member 160. A second upright member 170 extends upwardly from the upper member 160 to a distal end 172. As can be seen in FIG. 5, flanges 174 are positioned on the upper member 160 and the second upright member 170 to cooperate with the three-point hitch on the tractor 104 so that the frame 102 can be attached to the three-point hitch by fasteners (not shown) through holes 176 in the flanges 174.

Figure 10:
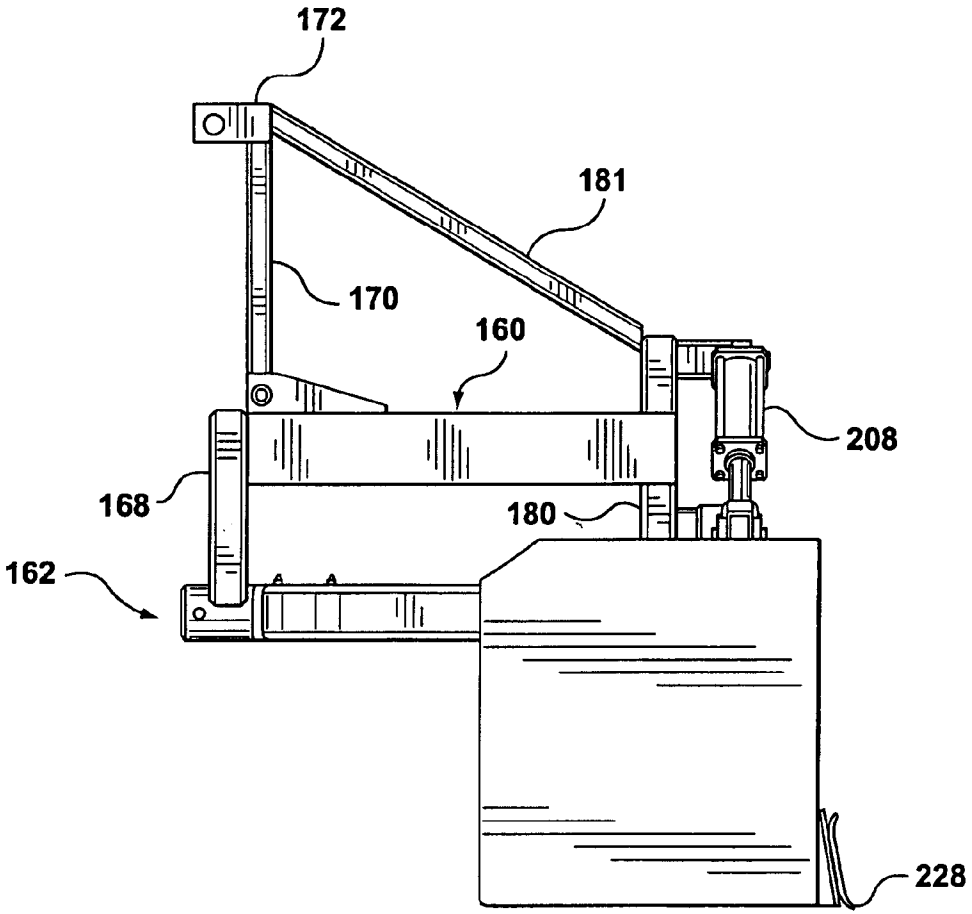
FIG. 10 is an elevation view of the left side of the scraper of FIG. 2.

As can be seen in FIG. 6, a second housing member 178 is positioned at the rearward end of the lower member 162. It is rigidly attached to the tube 163, and a third upright member 180 (FIG. 10) is attached to the second housing member 178 and extends upwardly to support the rearward side of the upper member 160. Preferably, the third upright member 180 also extends above the upper member 160, and a support member 181 extends from a top end of the third upright member 180 to the distal end 172 to provide support to the second upright member 170 (FIG. 10).

As can also be seen in FIG. 6, the frame 102 includes an outer left arm 182 extending from a third housing member 184 to the distal end 132 of the left portion 108. The third housing member 184 is rotatable about the tube 163, and includes a grease fitting 188 to facilitate lubrication. FIG. 6 also shows that the frame 102 includes a right outer arm 190 extending from a fourth housing member 192 to the distal end 134 of the right portion 110. The fourth housing member 102 is also rotatable about the tube 163, and includes a grease fitting 196 to facilitate lubrication of the fourth housing member 192.

FIGS. 5–8 also show an inner left arm 198 and an inner right arm 200. The inner left arm 198 is attached at one end thereof to the outer left arm 182, and extends to a proximal end 202 of the left portion 108, to strengthen the attachment of the left portion 108 to the outer left arm 182 (FIG. 8). Similarity, the inner right arm 200 is attached to the outer right arm 190 and extends to a proximal end 204 of the right portion 110, to strengthen the attachment of the right portion 110 to the outer right arm 190 (FIG. 8). The lower member 162 also includes a spacer member 206 for maintaining the positioning of the third and fourth housing members 178, 192 relative to the other housing members.

Hydraulic cylinders 208, 210 are pivotally attached at proximal ends 211, 212 thereof to an arm 214 extending from the third upright member 178 (FIG. 8). Distal ends 215, 216 of the hydraulic cylinders 208, 210 are pivotally attached at the distal ends 132, 134 of the left and right portions 108, 110 respectively by means of fittings 218 positioned at the distal ends 132, 134 and extending forwardly therefrom. It will be appreciated by those skilled in the art that, although hydraulic cylinders 208, 210 are preferred, other devices for moving the left and right portions 108, 110 relative to each other, and for maintaining the left and right portions 106, 110 in temporarily fixed positions relative to each other, could be used. Preferably, the hydraulic cylinders 208, 210 are operatively connected to the hydraulic system of the vehicle 104 via hydraulic hoses 219, as is known in the art (FIG. 5).

As can be seen in FIG. 8, the lower member 162 also includes fifth and sixth housing members 220, 222 to which left and right cross-members 224, 226 are attached respectively. The cross-members 224, 226 connect the inner left arm 198 to the fifth housing member 220 and the inner right arm 200 to the sixth housing member 222 respectively. The fifth and sixth housing members 220, 222 are also rotatable about the tube 153.

As can be seen in FIGS. 6 and 7, the sleeve 129 to preferably attached to the lower member 162, and the sleeve 129 forms part of the frame 102. In the preferred embodiment the sleeve 129 is rectangular in cross-section, for receiving the hook 126 which is also preferably rectangular in cross-section, and the sleeve 129 is welded or otherwise rigidly attached in a substantially vertical position to the lower member 162 at the rearward end thereof.

As shown in FIG. 7, the left bottom edge assembly 122 and the right bottom edge assembly 124 include rearward cutting edges 228, 230 respectively. Both the forward cutting edges 123, 125 and the rearward cutting edges 228, 230 are angled slightly outwardly at the lower ends thereof in order to facilitate cutting the friable material 114. More specifically, the forward cutting edges 123, 125 are angled slightly forwardly outward, to facilitate cutting through the friable material 114 as the left and right portions 108, 110 are moved forward. Similarly, the rearward cutting edges 228, 230 are angled rearwardly outward (FIG. 10), to facilitate cutting the friable material 114 as the left and right portions 108, 110 are moved backwards, or in reverse, over the friable material 114.

In use, the operator preferably engages the blade 106 with the friable material 114 at a downstream end of the predetermined design 118 in a specified location, i.e., the location where the swale is to be constructed. The operator raises or lowers the scraper 100 (i.e., using a three-point hitch or similar mechanism on the vehicle 104), and also positions the left and right portions 108, 110, to shape the friable material 114 substantially in accordance with the design 118.

The left and right portions 108, 110 are positioned in accordance with the design 118 by means of the hydraulic cylinders 208, 210. It will be appreciated by those skilled in the art that the positioning of the left and right portions 108, 110 in an initial pass, and in any subsequent pass over the specified location, would be determined by the operator based on the condition (e.g., elevation of higher spots, and width of higher spots) of the friable material 114 relative to the design 118.

As can be seen in FIG. 3, the gap 136 opens when at least one of the left and right portions 108, 110 is raised from the lowered position. The shield 130 is positioned for alignment in the gap 136, to move part of the friable material 114.

After initial engagement of the blade 106 with the friable material 114, the operator then moves the vehicle 104 over the friable material 114 from the downstream end to an upstream end, the articulated blade 106 and the shield 130 shaping the friable material 114 substantially in accordance with the design 118. As the vehicle 104 travels over the friable material 114, the operator raises or lowers the scraper 100 as necessary in order to follow the design 118 as closely as possible by controlling the hydraulic system of the vehicle 104, i.e., by means of the vehicle's three-point hitch or a similar hitch mechanism. In addition, the positions of the left and right portions 108, 110 are adjustable by the operator by means of the hydraulic cylinders 208, 210 as the vehicle 104 travels over the friable material 114. Although the vehicle 104 can be used in this way travelling backwards or forwards, it is preferable in most cases that, in the initial pass, the vehicle 104 travels in reverse from the downstream end to the upstream end.

Once the vehicle 104 has reached the upstream end, the articulated blade 106 and the shield 130 preferably are engaged again with the friable material 114 at the upstream end, and the articulated blade 106 and the shield 130 are again positioned to shape the friable material 114 substantially in accordance with the design 118. The operator then moves the vehicle 104 over the friable material 114 from the upstream end to the downstream end, adjusting the positioning of the scraper 100 as a whole and also adjusting the positioning of the left and right portions 108, 110 in order to shape the friable material 114 substantially in accordance with the design 118. It will be appreciated that the vehicle 104 is preferably driven forwardly from the upstream end to the downstream end in a final pass. By proceeding in this way, tracks of the vehicle's tires will be obliterated by the passage of the scraper 100 over them, and the swale will be finished in two passes.

It will be appreciated by those skilled in the art that the number of passes required and the direction of travel will depend in each case on a number of variable factors. For example, if the friable material 114 is relatively hard, then the operator may prefer to start in a first pass by using the hook 126 to break up the friable material 114, as described above. In these circumstances, it is preferred that the first pass begins at the upstream end. Once the scraper 100 is in position at the upstream end, the operator adjusts the height of the hook 126 so that the distal end 128 of the hook 126 is below the forward cutting edges 123, 125 of the left and right bottom edge assemblies 122, 124 respectively. When the vehicle 104 is moved forwardly from the upstream end towards the downstream end, the hook 126 plows a furrow in the friable material 114, breaking up the hard material. Subsequently, the operator may be able to complete the swale with only one additional pass with the hook 126 in the usual intermediate position (i.e., from the upstream end to the downstream end), or two or more additional passes (e.g., a pass from the downstream end to the upstream end, and a subsequent pass from the upstream end to the downstream end) may be required.

Also, those skilled in the art will appreciate that the movement of the vehicle 104 over the friable material 114 in the location specified for the swale serves to compact the friable material 114, thereby providing a more stable swale once completed.

It will be evident to those skilled in the art that the invention can take many forms, and that such forms are within the scope of the invention as claimed. For example, the scraper could be constructed so that the left and right portions could have lowered positions which are lower than the horizontal. Also, those skilled in the art will appreciate that the frame 102 could be constructed according to a variety of designs. Therefore, the spirit and scope of the appended claims should not be limited to the description of the preferred versions contained herein.

I claim:

1. A scraper for moving friable material, the scraper including:

a frame adapted for attachment to a vehicle;

an articulated blade having left and right portions mounted on the frame for pivoting about a substantially horizontal axis transverse to the articulated blade;

each of the left and right portions of the articulated blade being adapted for pivotal movement about the axis between a substantially horizontal lowered position and a raised position, and each portion being independently positionable in at least one position between the lowered position and the raised position movement of at least one of the left and right portion of the articulated blade from the lowered position opening a gap between the left and right portions;

the articulated blade being positionable for engagement with the friable material as the vehicle travels over the friable material for moving a part of the friable material to shape the friable material in accordance with a predetermined design, each of the left and right portions of the articulated blade having at least one cutting edge for engaging the friable material;

said at least one cutting edge on each of the left and right portions of the articulated blade being positioned at a predetermined distance below the frame when the left and right portions are in lowered position;

a shield adapted for moving the friable material, the shield being attached to the frame and depending from the frame and positioned for alignment with the gap and;

the shield having a bottom edge positioned at a distance below the frame which is substantially the same as the predetermined distance below the frame.

whereby the friable material is moveable by the articulated blade and the shield to conform with the predetermined design.

2. A scraper according to claim 1 additionally including:

a hook;

a sleeve forming part of the frame, for receiving a proximal end of the hook therein;

the hook including a distal end extending downwardly from the sleeve;

the hook being movable relative to the sleeve between a first position, in which the distal end projects below said at least one cutting edge of each of the left and right portions when the left and right portions are in the lowered position such that the hook plows a furrow in the friable material at a distance below the frame substantially greater than the predetermined distance, and a second position, in which the distal end is located at substantially the predetermined distance below the frame such that the hook plows a furrow in the friable material at substantially the predetermined distance below the frame.

3. A scraper for moving friable material, the scraper including;

a frame adapted for attachment to the vehicle;

an articulated blade having left and right portions mounted on the frame for pivoting independently of each other;

each of the left and right portions of the articulated blade being adapted for movement between a lowered position and a raised position, such that movement of at least one of the left and right portions from the lowered position opens a gap between the left and right portions;

a shield adapted for moving friable material, the shield being attached to the frame and positioned for alignment with the gap such that friable material is movable by the articulated blade and the shield to conform with the predetermined design;

each of the left and a right portions having at least one cutting edge adapted for engaging the friable material, said at least one cutting edge being positioned a predetermined distance below the frame when the left and right portions are in the lowered position;

a hook extending downwardly from the frame to a distal end thereof, the hook being moveable between a first position, in which the distal end projects below said at least one cutting edge such that the hook plows a furrow in the friable material at a distance below the frame substantially greater than the predetermined distance, and a second position in which the distal end is located at substantially the predetermined distance below the frame such that the hook plows a furrow in the friable material at substantially the predetermined distance below the frame;

each of the left and right portions being attached to the frame on forward sides thereof and including rearward sides positioned opposite to the forward sides, each of the left and the right portions including a forward cutting edge angled forwardly from the forward side thereof and a rearward cutting edge angled rearwardly from the rearward side thereof, each of the cutting edges being adopted and positioned for engagement with the friable material; and left and right side walls attached to the left and right portions respectively, the left and right side walls being positioned substantially orthogonally to the left and right portions respectively and extending forwardly therefrom, such that friable material is collectable by the left and right side walls, the articulated blade, and the shield when the articulated blade is engaged with the friable material as the vehicle travels forward over the friable material.

4. A scraper according to claim 3 in which the distal end of the hook includes a curved portion directed forwardly, the curved portion being adapted to plow a furrow in the friable material as the vehicle travels forward over the friable material.

5. A method of forming a swale having a furrow in a friable material in accordance with a predetermined swale design for a swale in a specified location, the method comprising the steps of:

(a) providing a vehicle having a front end and an opposed back end, the vehicle being adapted for forward and backward movement;

(b) providing a landscape box scraper for attachment to the back end of the vehicle, the scraper including:

(i) a frame adapted for attachment to the vehicle;

(ii) an articulated blade having left and right portions mounted on the frame for pivotal movement independently of each other;

(iii) each of the left and right portions of the articulated blade being adapted for pivotal movement between a lowered position and a raised position, such that movement of at least one of the left and right portions from the lowered position opens a gap between the left and right portions;

(iv) each portion being independently positionable in at least one position between the lowered position and the raised position;

(v) each of the left and right portions of the articulated blade having at least one cutting edge for engaging the friable material, movement of at least one of the left and right portions of the articulated blade from the lowered position opening a gap between the left and right portions;

(vi) a hook having a proximal end and a distal end, for plowing the furrow in the friable material;

(vii) a sleeve forming part of the frame, for receiving the proximal end of the hook therein to maintain the distal end in a predetermined position below the frame such that the furrow in the friable material is plowable by the hook;

(viii) a shield adapted for moving friable material, the shield being attached to the sleeve and positioned for alignment with the gap such that friable material is moveable by the articulated blade and the shield to confirm with the predetermined design;

(ix) each of the left portion and the right portion including a left bottom edge assembly and a right bottom edge assembly respectively, each of said assemblies including forward and rearward cutting edges, each said cutting edge being bent outwardly at a bottom end thereof relative to the left portion and right portion respectively to facilitate cutting the friable material;

(x) the frame being adapted to support the articulated blade such that the articulated blade and the shield are engageable with the friable material, for moving a part of the friable material to shape the friable material in accordance with the predetermined swale design as the vehicle travels over the friable material;

(c) attaching the landscape box scraper to the back end of the vehicle;

(d) engaging the articulated blade and the shield with the friable material at a downstream end of the swale design in the specified location, the articulated blade and the shield being positioned to shape the friable material substantially in accordance with the predetermined swale design;

(e) moving the vehicle over the friable material from the downstream end substantially to an upstream end of the swale design in the specified location, the rearward cutting edges engaging the friable material and the articulated blade and the shield shaping the friable material substantially in accordance with the predetermined swale design;

(f) engaging the articulated blade, the distal end of the hook, and the shield with the friable material at the upstream end in the specified location, the hook being positioned to form the furrow end the articulated blade and the shield being positioned to shape the friable material substantially in accordance with the predetermined swale design; and (g) moving the vehicle over the friable material from the upstream end to the downstream end, the hook plowing the furrow, the forward cutting edges engaging the friable material and the articulated blade and the shield shaping the friable material substantially in accordance with the predetermined swale design.

6. In a landscape box scraper for moving a part of a friable material to shape a swale in the friable material in accordance with a predetermined design, the scraper including a frame adapted for attachment to a vehicle and for supporting an articulated blade, the improvement comprising:

the articulated blade including a left portion and a right portion, each of the left portion and th right portion being pivotally mounted on the frame and independently movable between a lowered position and a raised position such that movement of at least one of the left and right portions from the lowered position opens a gap between the left and right portions;

the scraper additionally including a shield attached to the frame and adapted for moving the friable material;

the shield being attached to the frame and positioned for alignment with the gap such that friable material is movable by the articulated blade and the shield in accordance with the predetermined design;

each of the left and right portions having forward and rearward cutting edges adapted for engaging the friable material;

the scraper additionally including a hook having proximal end and a distal end for plowing a furrow in the friable material in accordance with the predetermined design; and a sleeve included in the frame, the sleeve being adapted to receive the proximal end of the hook therein and to maintain the distal end in a predetermined position relative to the frame such that the friable material is plowable by the hook in accordance with the predetermined swale design.

7. A landscape box scraper according to claim 6 in which the frame is positioned forward of the left and right portions and in which the landscape box scraper additionally includes left and right side walls attached to the left and right side portions respectively, the left and right side walls being positioned substantially orthogonally to the left and right blade portions respectively and extending forwardly, whereby friable material is retainable by the left and right side walls, the articulated blade, and the shield when the articulated blade and the shield are engaged with the friable material as the vehicle travels forward over the friable material.

8. A scraper for shaping a swale having a furrow in friable material in accordance with a predetermined design, the scraper having:

a frame adapted for attachment to a back end of a vehicle;

an articulated blade having left and right portions mounted on the frame for independent pivotal movement about a substantially horizontal axis transverse to the articulated blade, the axis being located substantially centrally between the left and right portions;

each of the left and right portions having a cutting edge assembly positioned along a lower edge thereof respectively to facilitate cutting the friable material;

each of the left and right portions being pivotable about the horizontal axis between a lowered position, in which the lower edges are substantially horizontal, and a raised position, in which a distal end of said portion is elevated above the lowered position;

each said cutting edge assembly including a forward and a rearward cutting edge, each said cutting edge being bent outwardly at a bottom end thereof relative to the left and right portions respectively to facilitate cutting the friable material;

a hook having a proximal end and a distal end, the distal end being adapted to plow a furrow in the friable material; and a sleeve included in the frame and adapted to receive the proximal end of the hook therein, the hook being positionable in a plurality of positions relative to the sleeve by adjustable fastening means for securing the proximal end in the sleeve, whereby the friable material is movable by the articulated blade, the hook, and the shield in accordance with the predetermined swale design.

9. A scraper according to claim 8 additionally including left and right side walls attached to the left and right portions respectively, the left and right side walls being positioned substantially orthogonally to the left and right portions at the distal ends thereof respectively and extending forwardly therefrom for collecting friable material when the scraper is moved forwardly.

* * * * *

UNITED STATES PATENT AND TRADEMARK OFFICE

CERTIFICATE OF CORRECTION

PATENT NO. : 6,843,001 B2
DATED : January 18, 2005
INVENTOR(S) : Richard Jenne

It is certified that error appears in the above-identified patent and that said Letters Patent is hereby corrected as shown below:

Column 12,
Line 41, replace “the hook, and the shield” with -- and the hook --.

Signed and Sealed this

Twenty-seventh Day of December, 2005

JON W. DUDAS
*Director of the United States Patent and Trademark Office*